US006922628B2

(12) United States Patent
Zhu et al.

(10) Patent No.: US 6,922,628 B2
(45) Date of Patent: Jul. 26, 2005

(54) IC ENGINE DIAGNOSTIC SYSTEM USING THE PEAK AND INTEGRATION IONIZATION CURRENT SIGNALS

(75) Inventors: Guoming G. Zhu, Novi, MI (US); Chao Daniels, Ann Arbor, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 26 days.

(21) Appl. No.: 10/723,097

(22) Filed: Nov. 26, 2003

(65) Prior Publication Data

US 2005/0114012 A1 May 26, 2005

(51) Int. Cl.[7] ..... G06G 7/70

(52) U.S. Cl. ..... 701/111; 701/109; 701/114; 73/35.01; 73/35.08; 73/35.09; 123/434; 123/435; 123/536; 123/406.21; 123/406.37

(58) Field of Search ..... 701/111, 109, 701/114; 123/536, 434, 435, 406.21, 406.37; 73/35.01, 35.07, 35.08, 35.09, 35.11

(56) References Cited

U.S. PATENT DOCUMENTS

| | | | | |
|---|---|---|---|---|
| 5,396,176 | A | 3/1995 | Ishii et al. | |
| 5,425,339 | A | 6/1995 | Fukui | |
| 5,925,819 | A | 7/1999 | Yoshinaga et al. | |
| 6,091,244 | A | 7/2000 | Rottler | |
| 6,104,195 | A | 8/2000 | Yoshinaga et al. | |
| 6,151,954 | A | 11/2000 | Aoki et al. | |
| 6,185,984 | B1 | 2/2001 | Takahashi | |
| 6,298,823 | B1 | 10/2001 | Takahashi et al. | |
| 6,328,016 | B1 | 12/2001 | Takahashi et al. | |
| 6,338,267 | B1 | 1/2002 | Karau | |
| 6,360,587 | B1 | 3/2002 | Noel | |
| 6,371,078 | B1 | 4/2002 | Kondo et al. | |
| 6,378,494 | B1 | 4/2002 | Hatazawa et al. | |
| 6,742,499 | B2 * | 6/2004 | Viele et al. | 123/406.14 |
| 6,805,099 | B2 * | 10/2004 | Malaczynski et al. | 123/435 |
| 6,832,472 | B2 * | 12/2004 | Huang et al. | 60/285 |
| 2002/0007818 | A1 | 1/2002 | Lodise et al. | |

FOREIGN PATENT DOCUMENTS

| | | |
|---|---|---|
| EP | 0477507 A3 | 4/1992 |
| EP | 0922856 A3 | 6/1999 |
| GB | 2345972 A | 7/2000 |
| GB | 2364128 A | 1/2002 |
| GB | 2396754 A | 6/2004 |

OTHER PUBLICATIONS

U.K. Patent Office, Combined Search and Examination Report Under Sections 17 & 18(3); dated Mar. 1, 2005; 4 pages.

* cited by examiner

*Primary Examiner*—Tony M. Argenbright
*Assistant Examiner*—Johnny H. Hoang
(74) *Attorney, Agent, or Firm*—Dickinson Wright PLLC

(57) ABSTRACT

The present invention includes an engine diagnostic method and routine, wherein a method of using an ionization signal to perform an engine diagnostic routine includes the steps of detecting the ionization signal; integrating the ionization signal over a first sampling window to generate a first integration ionization value; detecting a peak of the ionization signal over said first sampling window to generate a first peak ionization value; integrating the ionization over a second sampling window to generate a second integration ionization value; detecting a peak of the ionization signal over a second sampling window to generate a second peak ionization value; and diagnosing the engine using said ionization signal.

20 Claims, 10 Drawing Sheets

IC ENGINE DIAGNOSTIC SYSTEM USING THE PEAK AND INTEGRATION IONIZATION CURRENT SIGNALS

BACKGROUND OF THE INVENTION

1. Technical Field

This invention relates to the field of internal combustion (IC) engine diagnostics and control. More particularly, it relates to an IC engine diagnostic system that uses the peak and integration values of an ionization current signal to perform engine diagnostics.

2. Discussion

Combustion of an air/fuel mixture in the combustion chamber of an internal combustion (IC) engine produces ions that can be detected. If a voltage is applied across a spark plug gap, these ions are attracted and will create a current. This current produces a signal called an ionization current signal $I_{ION}$ that may be detected. After the ionization current signal $I_{ION}$ is detected, the signal may be processed within a powertrain control module (PCM) for engine diagnostics and closed-loop engine combustion control. Various methods may be used to detect and process the ionization current signals that are produced in a combustion chamber of an internal combustion engine.

FIG. 3 illustrates an ionization current signal processing circuit that samples ionization current signals directly, e.g., using an analog-to-digital (A/D) converter 110, and then processes the sampled ionization current signal $I_{ION}$ in a microprocessor 120. This circuit samples the ionization current signals at every crank degree of resolution over the compression and expansion strokes. This circuit also processes signals and performs engine diagnostic routines in a separate microprocessor 120 rather than in the powertrain control module (PCM) main processor 130, which lacks sufficient operating speed and memory 140 to handle the data sampling rate from the A/D converter 110. The use of a separate microprocessor 120 to process the increased data sample rate raises the manufacturing cost. In addition, the separate microprocessor 120 must have sufficient operating speed and memory to process the data samples from the A/D converter 110, thereby further increasing manufacturing cost.

SUMMARY OF THE INVENTION

In view of the above, the present invention is directed to an improved method of processing an ionization current signal from the combustion chamber of an internal combustion engine and performing engine diagnostics.

In a preferred embodiment, the invention includes a method of using an ionization signal to perform engine diagnostic including the steps of detecting the ionization signal; integrating the ionization signal over a first sampling window to generate a first integration ionization value; detecting a peak of the ionization signal over the first sampling window to generate a first peak ionization value; integrating the ionization signal over a second sampling window to generate a second integration ionization value; detecting a peak of the ionization signal over the second sampling window to generate a second peak ionization value; and performing the engine diagnostic routine with at least one of the first integration ionization value, the first peak ionization value, the second integration ionization value, and the second peak ionization value.

In another embodiment of the invention, a method of performing an engine diagnostic routine includes performing the engine diagnostic routine during a crank mode and performing the engine diagnostic routine during a normal operational mode for at least two banks of cylinders.

In yet another embodiment of this invention a computer system for performing an engine diagnostic routine includes a memory containing a program which performs the steps of detecting an ionization signal; integrating the ionization signal over a first sampling window to generate a first integration ionization value; detecting a peak of the ionization signal over the first sampling window to generate a first peak ionization value; integrating the ionization signal over a second sampling window to generate a second integration ionization value; detecting a peak of the ionization signal over a second sampling window to generate a second peak ionization value; and performing the engine diagnostic routine with at least one of the first integration ionization value, the first peak ionization value, the second integration ionization value, and the second peak ionization value; and a processor for running the program.

In a still further embodiment of the invention, a computer-readable medium includes contents that cause a computer system to perform an engine diagnostic routine, and the computer system has a program which executes the steps of: detecting an ionization signal; integrating the ionization signal over a first sampling window to generate a first integration ionization value; detecting a peak of the ionization signal over the first sampling window to generate a first peak ionization value; integrating the ionization signal over a second sampling window to generate a second integration ionization value; detecting a peak of the ionization signal over a second sampling window to generate a second peak ionization value; and performing the engine diagnostic routine with at least one of the first integration ionization value, the first peak ionization value, the second integration ionization value, and the second peak ionization value.

Further scope of applicability of the present invention will become apparent from the following detailed description, claims, and drawings. However, it should be understood that the detailed description and specific examples, while indicating preferred embodiments of the invention, are given by way of illustration only, since various changes and modifications within the spirit and scope of the invention will become apparent to those skilled in the art.

BRIEF DESCRIPTION OF THE DRAWINGS

The present invention will become more fully understood from the detailed description given here below, the appended claims, and the accompanying drawings in which:

DETAILED DESCRIPTION OF PREFERRED EMBODIMENTS

The present invention relates to detection of an ionization current signal produced in a combustion chamber of an internal combustion (IC) engine and processing of the ionization current signal to perform various engine diagnostic routines that access engine performance and operation.

This detailed description includes a number of inventive features generally related to the detection and processing of an ionization current signal. The features may be used alone or in combination with other described features.

In a Spark Ignition (SI) engine, the spark plug extends inside of the engine combustion chamber and may be used as a detection device. Use of the spark plug as a detection device eliminates the need to place a separate sensor into the combustion chamber to monitor conditions inside of the combustion chamber.

During engine internal combustion, chemical reactions at the flame front produce a variety of ions in the plasma. These ions, which include $H_3O^+$, $C_3H_3^+$, and $CHO^+$ ions, have an excitation time that is sufficiently long in duration to be detected. By applying a voltage across the spark plug gap, these free ions may be attracted to the region of the spark plug gap to produce an ionization current signal $I_{ION}$ 100*a*–100*n*.

Figure 1:
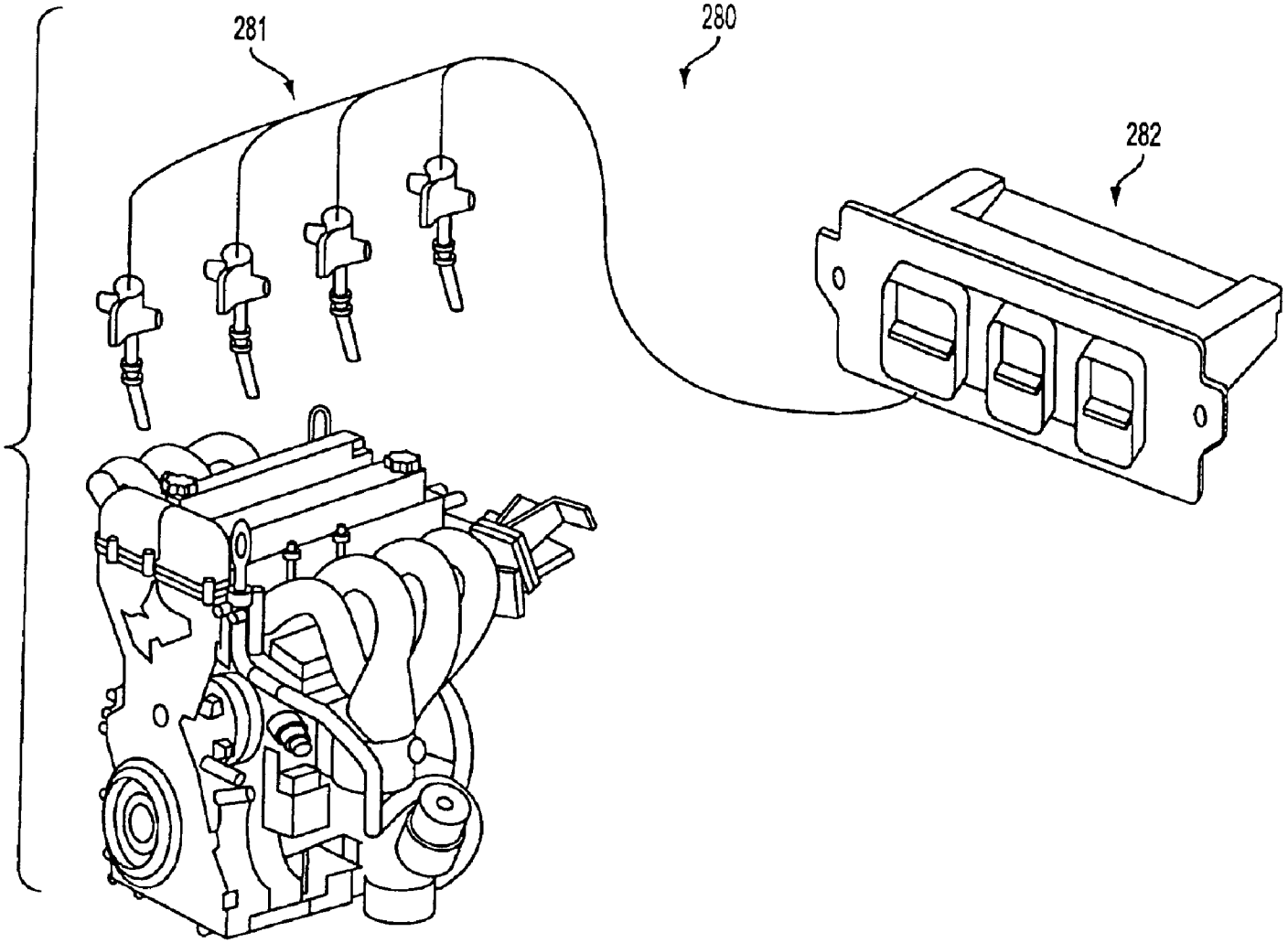
FIG. 1 illustrates an ionization current detection system.

As shown in FIG. 1, an ionization current detection system 280 consists of a coil-on-plug arrangement 281, which includes a device in each coil to apply a bias voltage across the spark plug gap (i.e., the spark plug tip). The coil-on-plug arrangement 281 is attached to a module 282 that includes an ionization current signal processing system.

Figure 2:
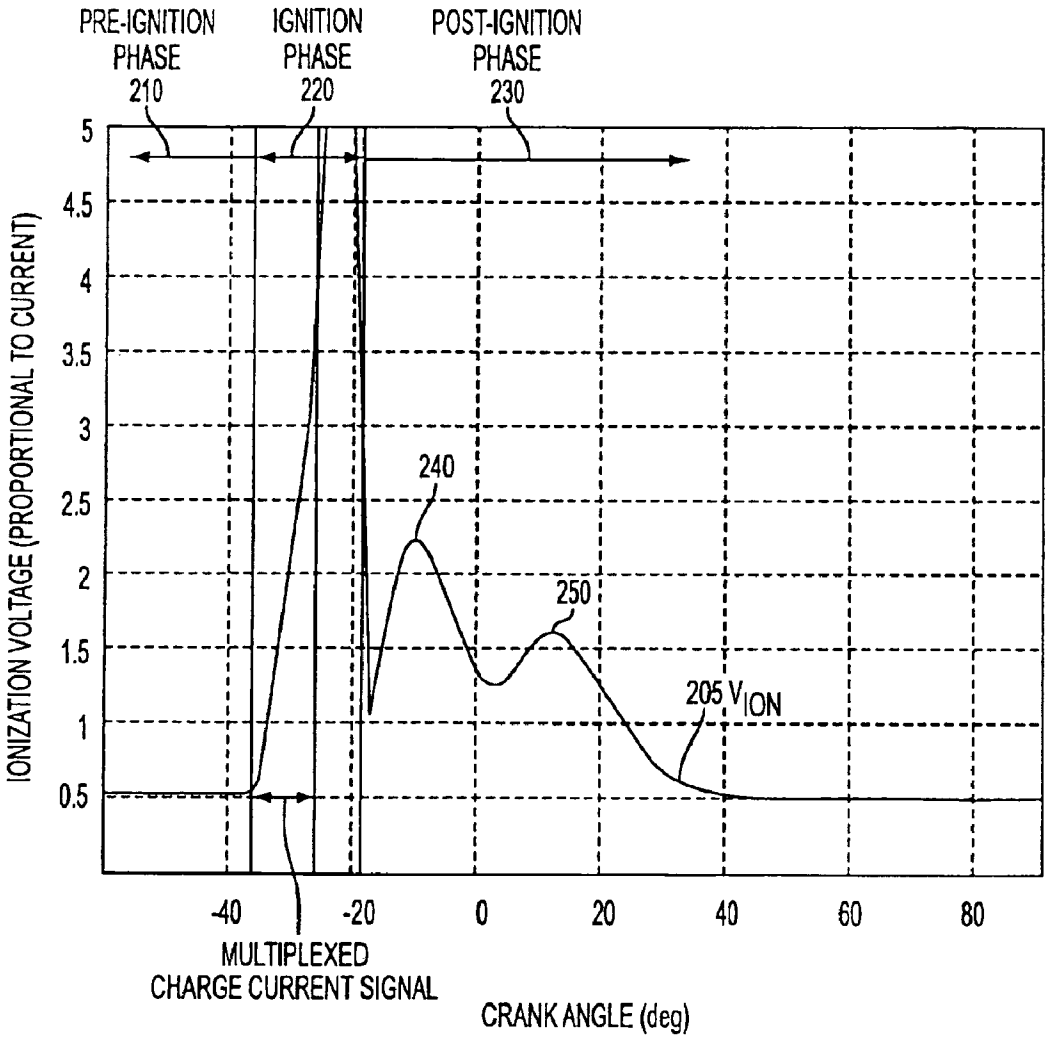
FIG. 2 is a graph of an ionization voltage signal.
Figure 3:
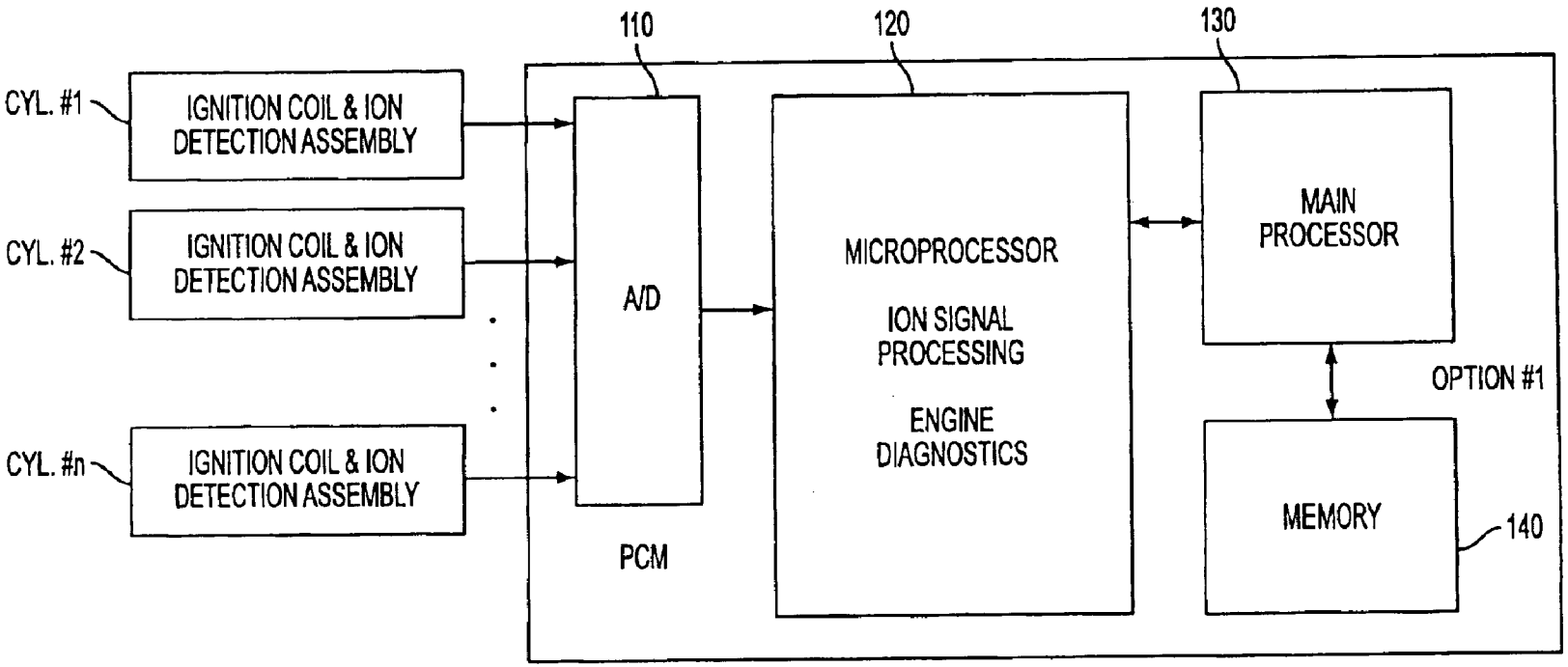
FIG. 3 illustrates a known engine diagnostics system.

The ionization current signal $I_{ION}$ measures the local conductivity at the spark plug gap during ignition and combustion. As shown in FIG. 2, the ionization current signal $I_{ION}$ changes during ignition and combustion. (Note that the ionization signal shown in FIG. 2 is an ionization voltage $V_{ION}$ 205, which is proportional to the detected ionization current signal $I_{ION}$ 100*a*–100*n* that flows across the spark plug gap during and after ignition.) The changes can be detected and compared to the engine crank angle of a cylinder at different stages of the combustion process.

The ionization current signal $I_{ION}$ 100*a*–100*n* typically has two phases: the ignition or spark phase 220, and the post-ignition or combustion phase 230. During the ignition phase 220, the ignition coil is charged and then discharged to ignite the air/fuel mixture. The post-ignition phase 230 is where combustion occurs. The post ignition phase 230 typically has two phases: the flame front phase and the post flame phase. The flame front phase occurs as the combustion flame (flame front movement during the flame kernel formation) develops in the cylinder. Under ideal circumstance, the flame front phase consists of a single peak. The ionization current signal $I_{ION}$ 100*a*–100*n* produced during the flame front phase has been shown to be strongly related to the air/fuel ratio. The post flame front phase is related to the temperature and pressure that develop in the cylinder. The post flame front phase generates an ionization current signal $I_{ION}$ 100*a*–100*n* whose peak is well correlated to the location of peak cylinder pressure, as discussed in more detail below.

FIG. 2 shows a graph of an ionization voltage signal $V_{ION}$ 205 that results from formation of an ionization current during the ignition phase 220 and the post-ignition phase 230. A bias voltage $V_{BIAS}$ is applied across the spark plug gap during the pre-ignition phase 210, the ignition phase 220, and the post-ignition phase 230. In a preferred embodiment, the bias voltage $V_{BIAS}$ is approximately 0.5 V. However, it will be appreciated by one of ordinary skill in the art that a bias voltage $V_{BIAS}$ greater or less than this value may be used depending upon engine operating conditions.

FIG. 2 also shows the phases of the ionization current during the ignition phase 220 and the post-ignition phase 230. During the ignition phase 220, an ignition coil is charged and then discharged, causing a current to arc across the spark plug gap and ignite the air/fuel mixture in the cylinder. Following the ignition phase 220, the bias voltage $V_{BIAS}$ attracts ions formed during combustion of the air/fuel mixture. As the ions, which typically include $H_3O^+$, $C_3H_3^+$, and $CHO^+$ ions, are attracted to the region of the spark plug gap by the bias voltage $V_{BIAS}$, an ionization current flows across the spark plug gap. This ionization current is represented by the ionization voltage signal $V_{ION}$ 205 in FIG. 2. During the post-ignition phase 230, the ionization voltage signal $V_{ION}$ 205 will rise to a peak voltage 240 as combustion progresses and the flame front moves through the cylinder. Depending upon combustion conditions in the cylinder, a second peak may arise 250 due to increases in the pressure and temperature in the cylinder.

Figure 4:
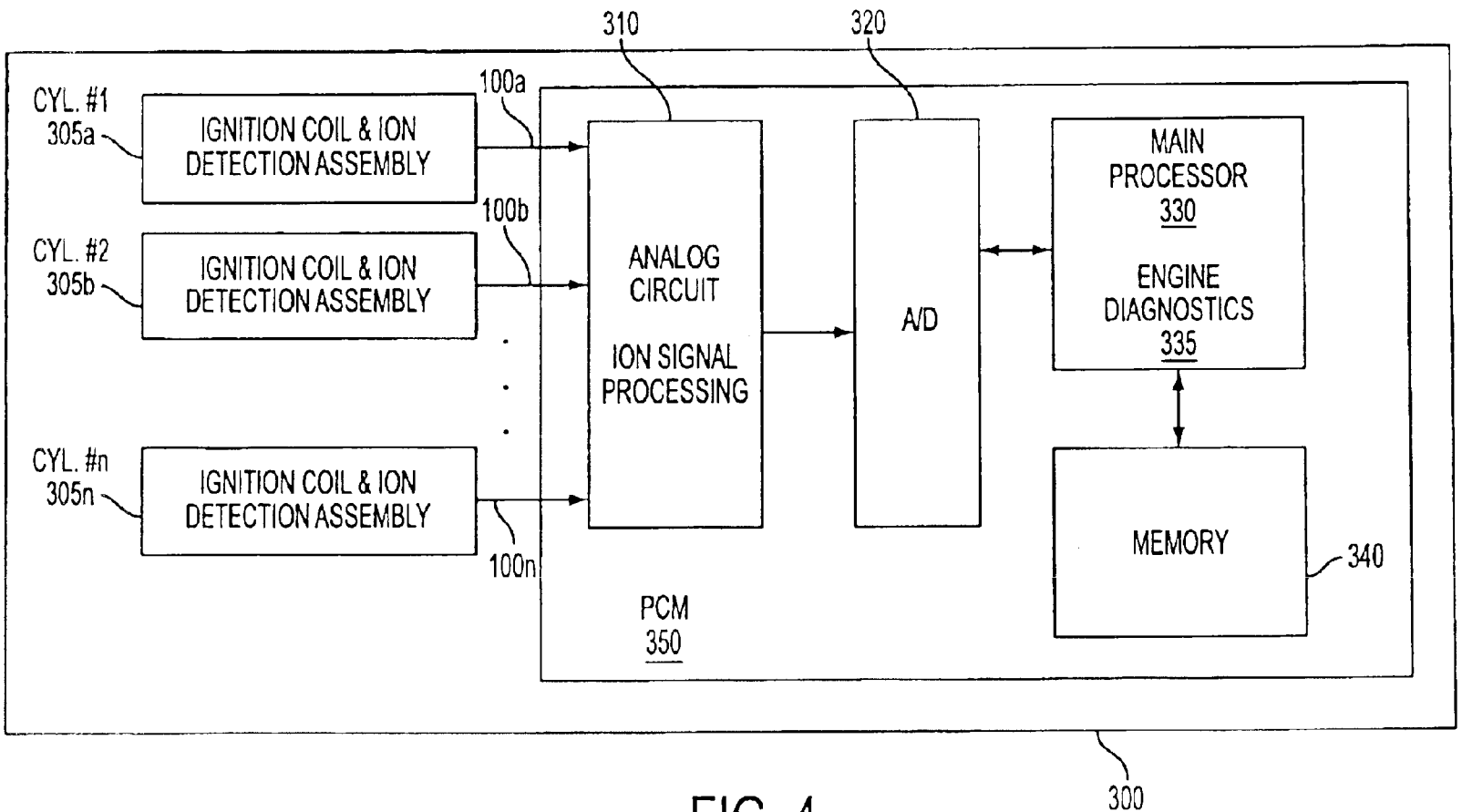
FIG. 4 illustrates an IC engine diagnostic system that uses ionization signals.

FIG. 4 illustrates an IC engine diagnostic system 300 that uses ionization current signals to perform engine diagnostic routines. The ionization current signal $I_{ION}$ 100*a*–100*n* is transmitted from the ion detection assemblies 305*a*–305*n* of each engine cylinder to an analog circuit 310 for ion signal processing. From the analog circuit 310, the processed ionization current signal $I_{ION}$ 100*a*–100*n* is transmitted to the analog-to-digital (A/D) converter 320. The analog-to-digital (A/D) converter 320, in turn, transmits the digitized ionization signals $I_{ION}$ 100*a*–100*n* to the main processor 330 of the powertrain control module (PCM) 350. The powertrain control module (PCM) 350 uses the conditioned, digitized signals to perform various engine diagnostic and control routines 335. The engine diagnostic routines include cylinder identification, full range misfire detection, and open-secondary detection. The configuration 300 enables the analog circuit 310 and the engine diagnostic routines of the main processor 330 to be recalibrated, as necessary. It also creates greater flexibility over a wide range of engine and internal combustion operating conditions and parameters.

Figure 5:
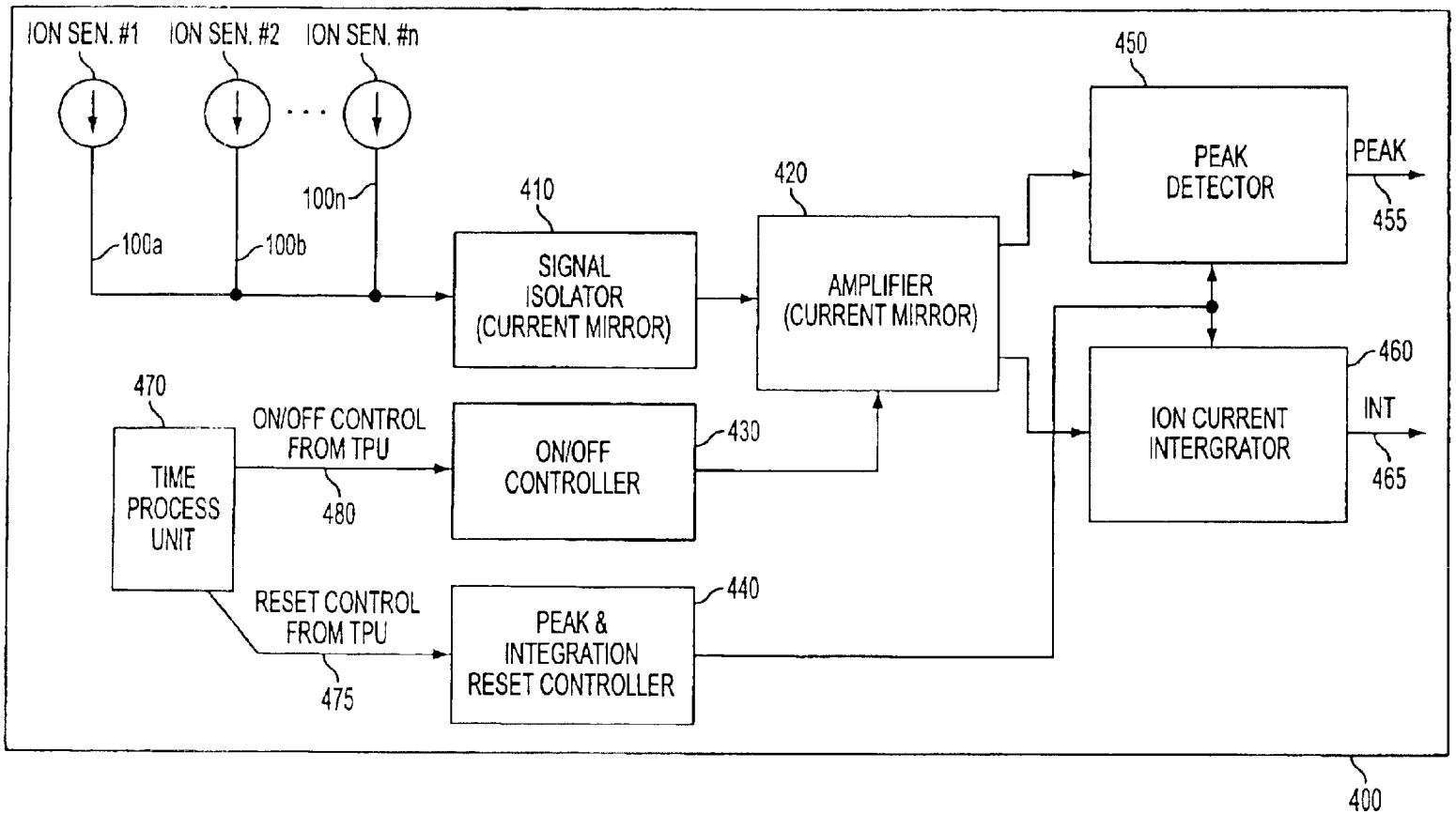
FIG. 5 illustrates an ionization signal conditioning system.

As shown in FIG. 5, an analog signal conditioning system 400 of a preferred embodiment of the present invention comprises a signal isolator 410, an amplifier 420, an on/off controller 430, a peak and integration reset controller 440, a peak detector 450, and an ion current integrator 460.

Two types of signals are input into the analog signal conditioning system 400. First, the analog signal conditioning system 400 receives the ionization signal $I_{ION}$ 100*a*–100*n* from the ionization sensors $I_{SENSOR\ 1\text{-}n}$ 305*a*–305*n* of an internal combustion engine. The analog signal conditioning system 400 also receives on/off control signals 480 and reset control signals 475 from a time processor, e.g., a time process unit (TPU) 470, of the powertrain control module (PCM) 350.

Due to the sequential nature of the engine combustion cycles, the ionization current signal 100*a*–100*n* from the ionization sensors 305*a*–305*n* may be combined as a single input to the signal isolator 410 of the analog signal conditioning system 400 without signal loss or distortion. One reason why the ionization current signal $I_{ION}$ 100*a*–100*n* can be multiplexed into one pin is that the ionization current signal $I_{ION}$ 100*a*–100*n* is active only during charging of the primary coil winding, ignition, and combustion. These three periods are referred to as the cylinder's active period, and they cover less than 120 crank degrees (see FIG. 2). Another reason that the ionization current signal $I_{ION}$ 100*a*–100*n* can be multiplexed is that the ionization current signal $I_{ION}$ 100*a*–100*n* is a current source. Therefore, it can be merged into a single signal that combines the individual ionization signals 100*a,* 100*b,* 100*n* from each cylinder without any significant loss or distortion of ionization signal information.

The signal isolator 410 isolates the detected ionization current signal by subtracting the bias current $I_{BIAS}$ from the ionization current signals $I_{ION}$ 100*a*–100*n*. The bias current $I_{BIAS}$ is produced when the bias voltage $V_{BIAS}$ is applied across the spark plug gap to produce the ionization current signals $I_{ION}$ 100*a*–100*n,* as discussed. The signal isolator 410 uses a current mirror circuit to remove the bias current $I_{BIAS}$ from the ionization current signal $I_{ION}$ 100*a*–100*n*. Then, the ionization current signal $I_{ION}$ 100*a*–100*n* is amplified and processed within the analog signal conditioning system 400, as discussed below.

The amplifier 420 receives the isolated ionization current signal $I_{ION}$ 100*a*–100*n* from the signal isolator 410. In a preferred embodiment, the amplifier 420 uses a current mirror circuit to amplify the ionization current signal $I_{ION}$ 100*a*–100*n*. The amplifier 420 also receives on/off control signals from the on/off controller 430.

The on/off controller 430 receives on/off control signals 480 from the time process unit (TPU) 470 of the powertrain control module (PCM) 350. The on/off controller 430 processes the on/off signals 480 and turns the amplifier 420 "On" and "Off," based on these signals, to enable peak detection and integration of the ionization current signal $I_{ION}$ 100*a*–100*n*.

The peak and integration reset controller 440 receives reset control signals 475 from the time process unit (TPU) 470 of the powertrain control module (PCM) 350. The reset controller 440 processes these signals and resets the peak detector 450 and the ion current integrator 460 to their respective default values. After the peak detector 450 is reset, the peak detector 450 processes the amplified ionization current signal when the amplifier 420 is turned "On" by the on/off controller 430 to generate a peak ionization signal $I_{PEAK}$ 455. The peak ionization signal $I_{PEAK}$ 455 can be transmitted to the powertrain control module (PCM) 350 or a similar engine diagnostic and control processor. After the ion current integrator 460 is reset, the ion current integrator 460 processes the amplified ionization current signal when the amplifier is turned "On" by the on/off controller 430 to generate an integration ionization current signal $I_{INT}$ 465. The integration ionization current signal $I_{INT}$ 465 can be transmitted to the powertrain control module (PCM) 350 or a similar engine diagnostic and control processor.

The peak detector 450 receives the amplified ionization current signal $I_{ION}$ 100*a*–100*n* from the amplifier 420 and generates the peak ionization signal $I_{PEAK}$ 455. In a preferred embodiment, the peak ionization signal $I_{PEAK}$ 455 equals the peak ionization voltage measured since the last reset of the peak detector 450 during the period when the amplifier 420 is turned "On" by the on/off controller 430. In a preferred embodiment of the invention, the peak detector 450 generates a peak ionization signal $I_{PEAK}$ 455 for the ignition phase 220 and the post-ignition phase 230. However, the peak detector 450 may generate more or less than two peak ionization signals $I_{PEAK}$ 455, depending upon engine operating conditions and engine diagnostic routines.

The ion current integrator 460 receives the amplified ionization current signal $I_{ION}$ 100*a*–100*n* from the amplifier 420 and generates the integration ionization signal $I_{INT}$ 465. In a preferred embodiment, the integration ionization signal $I_{INT}$ 465 equals the integrated value of the ionization current $I_{ION}$ since the last reset of the ion current integrator 460 during the period when the amplifier 420 is turned "On" by the on/off controller 430. In a preferred embodiment of the invention, the ionization current signal $I_{ION}$ is integrated for the ignition phase 220 and the post-ignition phase 230. However, the ion current integrator 460 may generate more or less than two integration ionization signals $I_{INT}$ 465, depending upon engine operating conditions and engine diagnostic routines.

Figure 6:
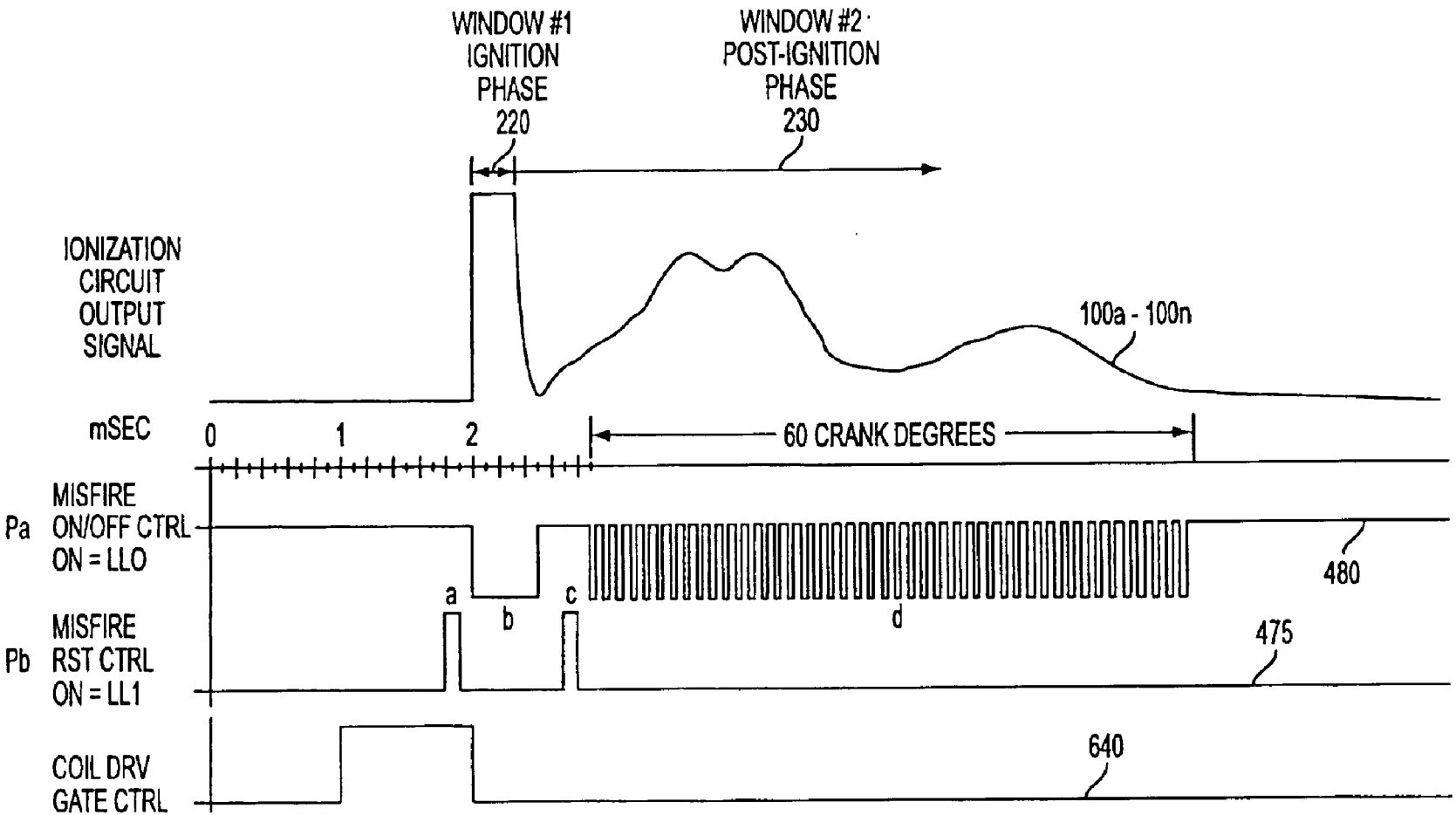
FIG. 6 illustrates a graph of an ionization current signal, an on/off control signal, a reset control signal, and an ignition charge signal.

FIG. 6 shows representative input and output signals for the signal conditioning system 400 in a normal combustion case. The top chart of FIG. 6 is the ionization current signal $I_{ION}$ 100*a*–100*n* that is received from the ionization sensors 305*a*–305*n*. The second and third charts are the on/off control signal Pa 480 and the reset control signal Pb 475, respectively, that are transmitted from the time phase unit (TPU) 470 to the analog conditioning system 400. An ignition charge signal 640 is shown as the bottom curve on the chart.

The on/off control signal 480 and the reset control signal 475 are pulse-trains. The on/off control signal 480 is "On" at Logic Level 0 ("LL0"). The reset control signal 475 is "On" at Logic Level 1 ("LL1"). Operation of the on/off control signal 480 and the reset control signal 475 can be described according to the following regions. Initially, at time=0.0–0.15 msec, the on/off control signal 480 and the reset control signal 475 are in their "Off" states. This "Off" state is indicated as LL1 (inactive "High") for the on/off control signal 480 and LL0 (inactive "Low") for the reset control signal 475. In Region a, the reset control signal 475 is turned "On" and "Off" to reset the integrator 460 and the peak detector 450 prior to the ignition phase 220. This reset enables the peak detector 450 to generate a peak ionization signal $I_{PEAK}$ 455 and the integrator 460 to generate an integration ionization signal $I_{INT}$ 465 for the ignition phase 220, which is identified as Window #1.

In Region b, the on/off control signal 480 is turned "On." The on/off controller 430 turns the amplifier 420 "On" so that the peak detector 450 receives an amplified ionization current signal $I_{ION}$ 100*a*–100*n* and detects a peak ionization signal $I_{PEAK}$ 455 for the ignition phase 220 (Window #1). The integrator 460 receives an amplified ionization current signal $I_{ION}$ 100*a*–100*n* and generates an integration ionization signal $I_{INT}$ 465 for the ignition phase 220 (Window #1). The integration ionization signal $I_{INT}$ can be used to perform open-secondary coil, engine misfire and partial-burn, and cylinder identification diagnostic routines. The spark window of Region b is approximately 500 microseconds in FIG. 6. However, a spark window of greater or lesser duration can be used depending on engine operating conditions and ignition systems. For example, the spark window can last anywhere between 300 microseconds and 3 milliseconds, depending on the actual spark duration of an ignition system.

In the region between Region b and Region c, the on/off control signal 480 is turned to the "Off" state. This turns the amplifier 420 "Off" and stops any further charging of the peak detector 450 and the integrator 460. The integration ionization signal $I_{INT}$ 465 may be compared to a threshold value to determine whether a proper ignition charge was delivered to the cylinder, i.e., whether a spark occurred. If the integration ionization signal $I_{INT}$ 465 for the spark window exceeds a threshold value, a determination is made that a spark has occurred. If the integration ionization signal $I_{INT}$ 465 is below this threshold value, no spark occurred.

In Region c, the reset control signal 475 is turned "On" and "Off." This control action resets the integrator 460 and the peak detector 450 to their default values. Thus, peak detection and integration may be conducted for the ionization current signal $I_{ION}$ 100*a*–100*n* produced during the post-ignition phase 230, which is identified as Window #2.

In Region d, the reset control signal 475 is maintained in an "Off" state, and the on/off control signal 480 is turned "On" and "Off." This reset control action enables the peak detector 450 and the integrator 460 to detect the peak ionization signal $I_{PEAK}$ 455 and the integration ionization signal $I_{INT}$ 465, respectively, during the post-ignition phase 230. The on/off controller 430 uses pulse width modulation (PWM) to adjust the on/off control signal Pa 480. Pulse width modulation enables calculation of the peak ionization signal $I_{PEAK}$ 455 and the integration ionization signal $I_{INT}$ 465 for the post-ignition phase 230 at varying engine revolutions per minute (RPM) without data overflow occurring. The frequency is fixed at 10 kHz. However, a higher or lower frequency may be used depending upon engine operating conditions. The pulse width duty cycle of the on/off control signal 480 varies during the ON-cycle according to engine RPM, as shown in the following table:

| | |
|---|---|
| RPM < 1500 | 20% Duty Cycle |
| 1500 ≦ RPM < 3000 | 40% Duty Cycle |
| 3000 ≦ RPM < 4500 | 60% Duty Cycle |
| 4500 ≦ RPM < 6000 | 80% Duty Cycle |
| 6000 ≦ RPM | 100% Duty Cycle |

The duty cycle of the pulse-width modulated control signal 480 is a function of engine speed in RPMs, as described above. Pulse width modulation is used over Region d, primarily to avoid integration overflow and to obtain a good signal-to-noise ratio. The integration window of Region d is based on crank degrees of an engine cycle. In a primary embodiment of the invention, the integration window is taken over 60 crank degrees. Of course, an integration window of more or less than 60 crank degrees may be used. At 600 RPM, an integration window of 60 crank degrees has a duration of approximately 16.17 ms. At 6000 RPM, an integration window of 60 crank degrees has a duration of approximately 1.667 ms. Thus, time-based integration over a fixed crank degree increases by a factor of ten at 600 rpm, compared to time-based integration over the same fixed crank degree at 6,000 RPM.

A conventional approach to avoiding integration overflow is the use of variable integration gain. However, this approach is relatively expensive to implement, particularly in an analog circuit. According to the present invention, pulse-width modulated of the on/off control signal 480 may be used to switch the amplifier 420 "On" and "Off" so that integration is continuous at high engine RPMs and discontinuous at duty cycles where the engine speed is below a selected RPM. This approach avoids integrator overflow while maintaining good resolution of signal output.

The integration ionization signal $I_{INT}$ 465 for the post-ignition phase 230 (Window #2) can be used in various diagnostic routines. For example the misfire and partial-burn diagnostic routine uses a corrected, i.e., normalized, integration ionization signal $INTC_{12}$ (i=1, 2) for the second window (Window #2). In these embodiments of the invention, the integration ionization current signal $I_{INT}$ 465 for the post-ignition phase 220 (window #2) may be normalized to convert the time domain integration into a crank angle based value. The integration ionization signal $I_{INT}$ 465 for the second window may be expressed in crank degrees according to the following formula:

$$\int Ion(\theta)d\theta=(\int Ion(t)dt)\times 6\times RPM(i=1 \text{ or } 2)$$

The time based integration ionization value for the second window $INTC_{12}$ is output from the analog conditioning circuit 400 as a function of engine speed and may be related to engine RPM by the following formula:

$$INT_{12}=\int Ion(t)dt\times PWM_{DC}=\int Ion(\theta)d\theta\times PWM_{DC}/(6\times RPM)$$

Therefore, the integration ionization signal $I_{INT}$ 465 obtained from the analog signal conditioning system 400 for the post-ignition phase 220 (Window #2) may be normalized to convert the time domain integration into a crank angle based value based on engine RPM. That is, $$INTC_{12}=\int Ion(\theta)d\theta=6\times RPM\times INT_{12}/PWM_{DC}$$

Because the pulse width duty cycle ($PWM_{DC}$) is a function of engine speed, the time based integration $INTC_{12}$ can be converted into a crank based one using the following table:

| Engine Speed (RPM) | $INTC_{i2}$ |
|---|---|
| RPM ≦ 1500 | 1.2 × $INT_{i2}$ × RPM |
| 1500 < RPM ≦ 3000 | 2.4 × $INT_{i2}$ × RPM |
| 3000 < RPM ≦ 4500 | 3.6 × $INT_{i2}$ × RPM |
| 4500 < RPM ≦ 6000 | 4.8 × $INT_{i2}$ × RPM |
| 6000 < RPM | 6.0 × $INT_{i2}$ × RPM |

After Region d, the on/off control signal 480 is turned "Off" and the reset control signal 475 remains "Off." The outputs of the integrator 460 and the peak detector 450 are read to yield the integration ionization signal $I_{INT}$ 465 and the peak ionization signal $I_{PEAK}$ 455, respectively, for the post-ignition phase 230 (Window #2).

Figure 7:
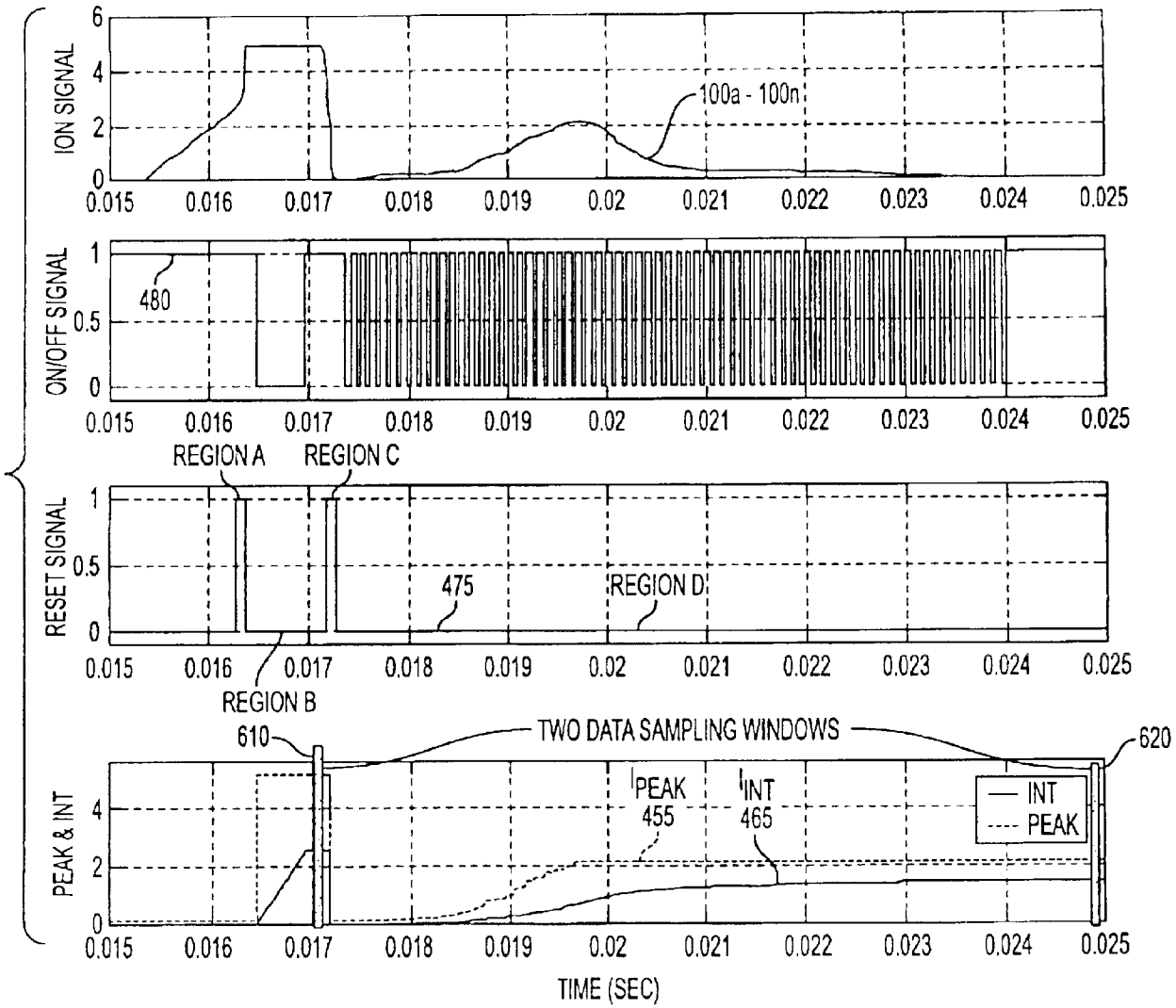
FIG. 7 is a graph of peak detection and integration ionization signals with input ionization and control signals in a normal combustion case.

As shown in FIG. 7, two data samples 610, 620 are taken during each engine combustion cycle. These data samples 610, 620 are processed to generate the integration ionization signal $I_{INT}$ 465 and the peak ionization signal $I_{PEAK}$ 455 for a normal combustion case. The first data sample 610 is taken at the first data sampling window (Window #1) to generate the integration ionization signal $I_{INT}$ 465 and the peak ionization signal $I_{PEAK}$ 455 for the ignition phase 220. The second data sample is taken at the second data sampling window (Window #2) to generate the integration ionization signal $I_{INT}$ 465 and the peak ionization signal $I_{PEAK}$ 455 for the post-ignition phase 230. The analog signal conditioning system 400 processes the data from these two samples to generate the peak ionization signal $I_{PEAK}$ 455 and an integration ionization signal $I_{INT}$ 465 for the ignition phase 220 and the post-ignition phase 230. The analog signal conditioning system 400 outputs these values to the powertrain control module (PCM) 350. Therefore, the analog signal conditioning system 400 samples the ionization current during the ignition phase 220 and the post-ignition phase 230 and generates two peak and two integration ionization signals for each engine combustion cycle. Thus, four parameters are sent to the powertrain control module (PCM) 350 for cylinder identification, ignition diagnostics, misfire/partial burn detection, and similar engine diagnostic routines during each engine combustion cycle. However, a person of ordinary skill in the art will appreciate that any number of data sampling windows may be used according to the present invention, depending upon engine diagnostic requirements, operating conditions, and similar parameters.

The analog signal conditioning system of the present invention significantly reduces the data sample rate compared to known signal conditioning systems. According to one embodiment consistent with the present invention, the ionization current signals $I_{ION}$ 100*a*–100*n* from each cylinder may be sampled one time for each engine combustion event, i.e., the ignition phase 220, the post-ignition phase 230, and two times for each engine combustion cycle. This sample rate is substantially less than the hundreds of samples that are taken per engine combustion cycle in known systems that use a separate microprocessor to sample ionization current signals directly. In known systems, the ionization current signals $I_{ION}$ 100*a*–100*n* are sampled at least every crank degree or several hundred times per engine combustion cycle. The present invention reduces the data sample rate by a factor of over 100 per engine combustion cycle, thereby producing considerable savings and increased efficiencies.

The analog circuit 310 of the present invention may be integrated with the powertrain control module (PCM) 350, e.g., it may be part of the same circuit board, as shown in FIG. 4. This configuration minimizes manufacturing costs and increases the flexibility of the system. The memory 340 of the powertrain control module (PCM) 350 does not have to be increased to accommodate an increased data sample rate because the analog circuit 310 uses two data samples per engine combustion cycle. The use of pulse width modulation enables the analog circuit 310 to condition and output two peak ionization signals and two integration ionization signals over a wide range of engine operating conditions. In addition, the engine diagnostic routines 335 of the powertrain control module (PCM) 350 may be varied for different operating conditions. This flexibility enables the main processor 330 to process integration ionization signals $I_{INT}$ signal 465 and peak ionization signal $I_{PEAK}$ 455 over a wide range of engine operating conditions. In a preferred embodiment, the analog-to-digital (A/D) converter 320 can be part of the main processor 330. In other embodiments, the analog circuit 310 may be separate from the powertrain control module (PCM) 350.

Figure 8:
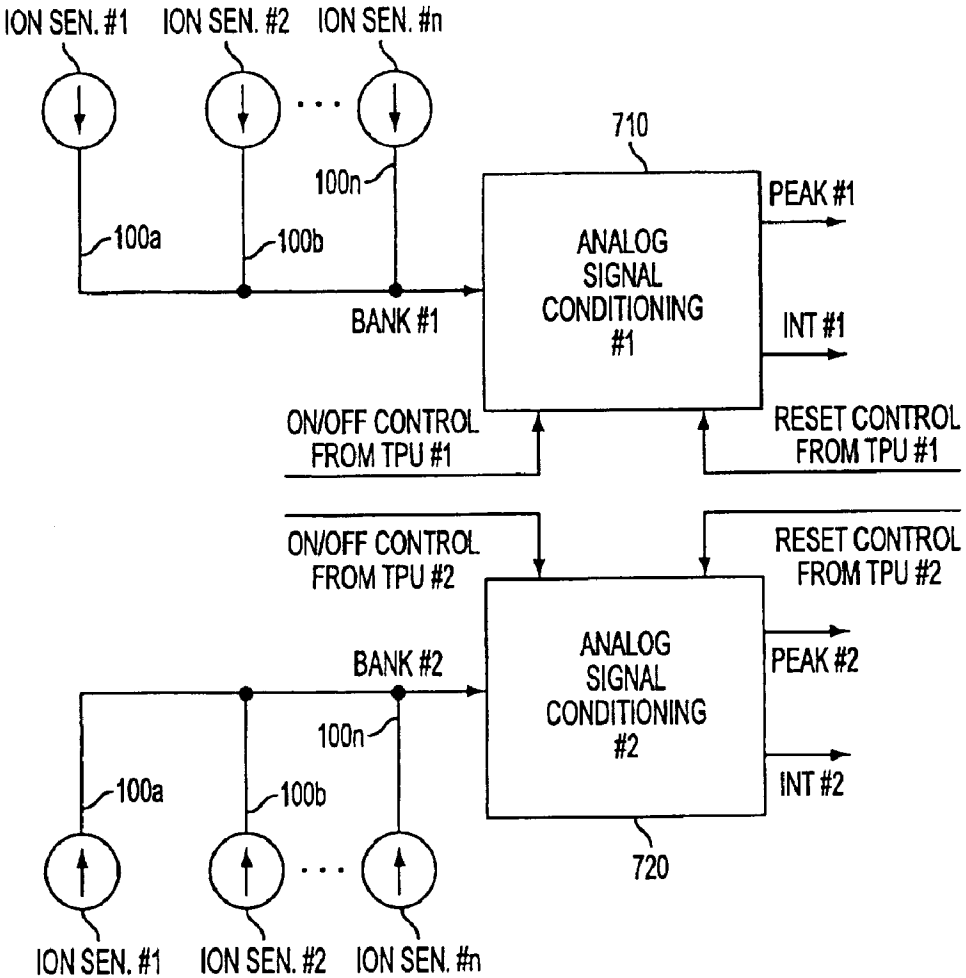
FIG. 8 illustrates an engine diagnostics system.

Two or more analog circuits 310 may be combined to process and condition ionization current signals $I_{ION}$ 100*a*–100*n*. FIG. 8 shows an embodiment of the invention comprising two analog circuits 710, 720. In this embodiment, the cylinders of an IC engine are divided into two cylinder banks, Bank #1 and Bank #2. Each cylinder bank is connected to one of the analog circuits 710, 720, as shown in FIG. 8. In an application for a four-cylinder IC engine with a firing order of 1, 3, 4, 2, one cylinder bank, e.g., Bank #1, may comprise cylinders 1 and 3 and another cylinder bank, e.g., Bank #2, may comprise cylinders 2 and 4. For a "V" engine, cylinders of the IC engine may be divided between Banks #1 and #2. Division of the IC engine cylinders into Banks #1 and #2 enables the pairing of cylinders in offsetting compression/expansion and exhaust/intake strokes for improved cylinder identification and avoidance of interference between respective ionization signals, particularly as the number of cylinders increases.

In a preferred embodiment of the invention with two data sampling windows, each analog conditioning circuit 710, 720 conditions two ionization signal samples to generate four values—two integration ionization signals $I_{INT}$ 465 and two peak ionization signal $I_{PEAK}$ 455 for each combustion cycle. Together, the analog circuits 710, 720 produce eight values per engine combustion cycle. The analog circuits 710, 720 transmit those values to the powertrain control module (PCM) 350 for cylinder identification, misfire/partial burn detection, and similar engine diagnostic routines.

The present invention may be used to perform cylinder identification during engine crank mode. When the gas mixture in a cylinder is compressed, its density increases, and therefore, the breakdown voltage between the spark plug electrodes increases. The breakdown voltage also depends on a number of different factors (density, humidity, temperature, etc). The increased break down voltage produces several discernable effects. For example, the spark duration in a cylinder in a compression stroke will be shorter than the spark duration in a cylinder that is not in a compression stroke. Further, it will take longer for voltage to build up before the spark arcs. As the energy dissipates and the voltage drops, the spark will end sooner in the cylinder in compression stroke, assuming that the ignition coils for each cylinder received the same ignition energy charge. The analog signal conditioning system 400 can identify the cylinder that is in compression by integrating the ionization signal over the spark window, i.e., during the ignition phase 220 for each cylinder, and comparing the integration ionization signal $I_{INT}$ 465 for the spark window to a predetermined threshold value.

In another embodiment of the invention, the analog conditioning system performs engine misfire and partial-burn diagnostic routines using the integration and peak ionization current signals over Region d. When the peak ionization current signal $I_{PEAK}$ and the integration ionization current signal $I_{INT}$ are greater than predetermined thresholds, normal combustion is declared. If only one of the peak ionization signal $I_{PEAK}$ or the integration ionization signal $I_{INT}$ is greater than a predetermined threshold, a partial-burn combustion is declared. This situation occurs in a partial-burn cycle because combustion occurs relatively late, thereby yielding a reduced integration value over Region d. If the peak ionization signal $I_{PEAK}$ and the integration ionization signal $I_{INT}$ are less than their respective predetermined threshold, a misfire is declared.

The analog signal conditioning system may be used to perform open-secondary winding detection, failed coil/ion-sensing assembly, and bank sensor/input short to ground diagnostic routines. An open secondary winding can be detected by observing whether a spark occurs. In a preferred embodiment, the ionization signal $I_{ION}$ is integrated over the spark window and the integration ionization signal $I_{INT}$ is compared to a threshold value. If the integration ionization signal $I_{INT}$ is less than the threshold value, the diagnostic routine determines that no spark occurred and declares an open secondary winding. When a spark does not occur, the integration ionization signal $I_{INT}$ is less than the threshold value because the secondary winding produces only an internal "ringing" current. As a result, the ionization signal over the spark window approximates a 50 percent duty cycle square wave. If the peak ionization value detected over the spark window is below a threshold value, a failed coil and ion-sensing assembly is declared. If the peak ionization signal detected over the combustion window (Region d) is less than a threshold value, a bank sensor/input short to battery is declared. Each of these diagnostic routines is discussed in greater detail below.

Figure 9:
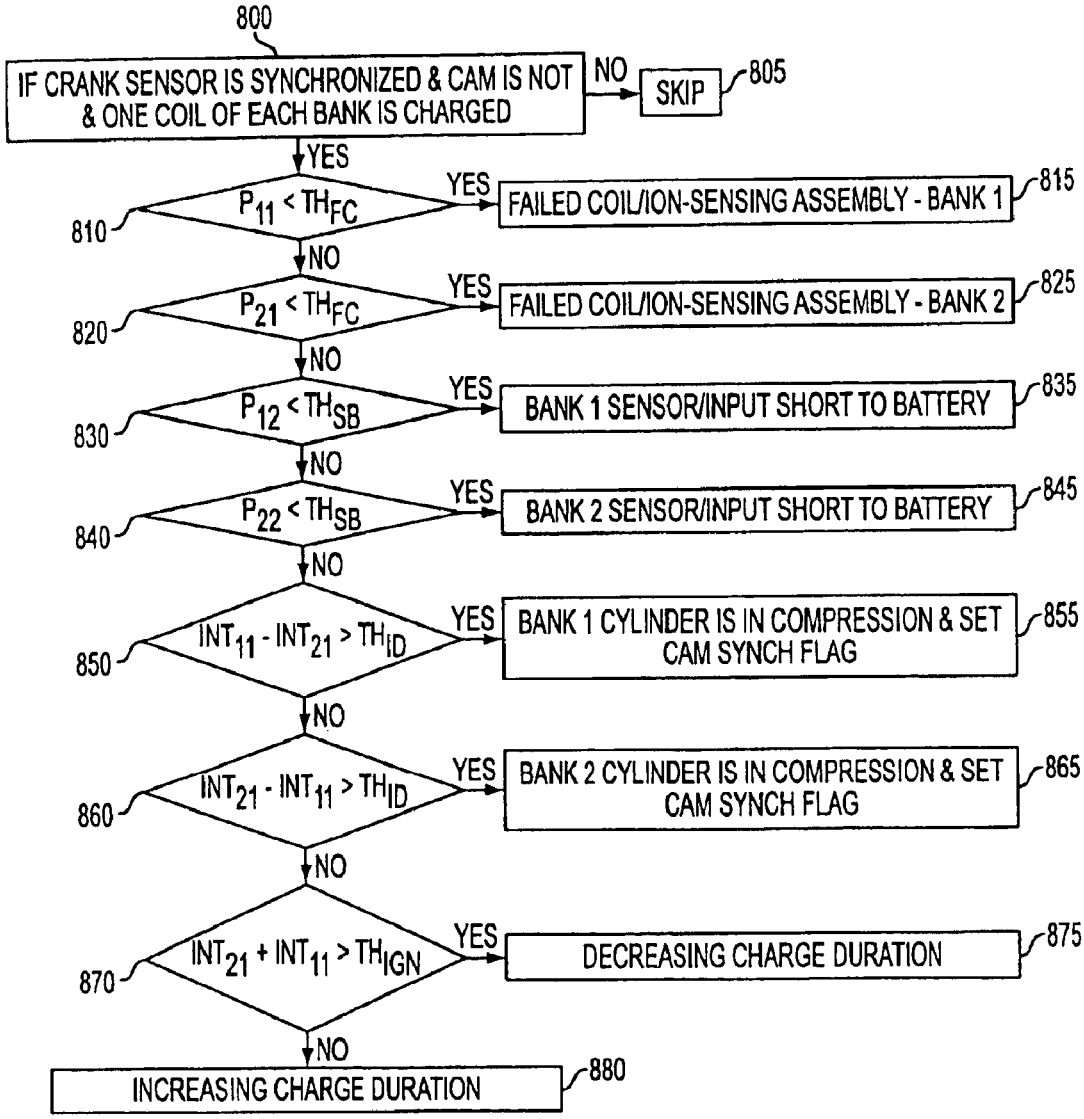
FIG. 9 is a block diagram for a crank mode diagnostic routine.

According to preferred embodiments of the invention, engine diagnostic routines may be executed during engine crank mode and normal engine operation mode. FIG. 9 is a block diagram of an engine diagnostic routine that is performed during engine crank mode. The crank mode diagnostic routine, e.g., an algorithm, performs engine diagnostic and cylinder identification subroutine once a number of pre-conditions are met. The crankshaft sensor must be synchronized, the camshaft is not synchronized, and an ignition coil of each cylinder bank must be charged 800 and discharged near the TDC (top dead center). If any of these conditions is not met, the main processor 330 does not perform the crank mode diagnostics control routine 805. The crank mode diagnostic routine will be executed until the camshaft is synchronized.

The crankshaft position sensor detects the revolutions per minute ("rpm") and the rotational position of the crankshaft. In a preferred embodiment, the crankshaft position sensor is a magnetic pickup, a Hall-effect switch, or a variable reluctance sensor. As the crankshaft rotates, the crankshaft position sensor generates a signal based on the position of the crankshaft, and engine rpm can be calculated based on signals from the crankshaft position sensor. The signal is transmitted to the ignition module and/or the main processor 330, which processes the signal to identify the piston in each cylinder bank that is at top dead center (TDC) and generates the ignition dwell pulses for the cylinder of each bank that will be at TDC in the next cycle. After the ignition is completed, the crank mode diagnostic routine can identify the cylinder that is in its compression stroke, and complete the cylinder identification process. When the dwell pulse width is too wide or narrow to identify the cylinder that is in its compression stroke, the diagnostic routine adjusts the pulse width in an interactive process described in more detail below until the cylinder identification process is completed.

Once the crankshaft position sensor is synchronized and a coil in each cylinder bank is charged and discharged, the engine crank mode diagnostic routine samples the peak ionization signal $I_{PEAK}$ and the integration ionization signal $I_{INT}$ over two data sampling windows 610, 620 for each cylinder bank. In a preferred embodiment of the invention, the crank mode diagnostic routine samples the peak ionization signal $P_{i1}$ and the integration ionization signal $INT_{i1}$ (i=1, 2) for both Bank #1 and Bank #2 during the ignition phase 220, also referred to as the spark window 610, and during the post-ignition phase 230, also referred to as the combustion window 620.

If the crankshaft position sensor is synchronized, the cam synchronization flag is not set, and the ignition coils in each cylinder bank are charged and discharged, the crank mode diagnostic routine performs a failed coil/ion-sensing assembly diagnostic subroutine 810, 820. This subroutine compares the peak ionization signal $P_{i1}$ (i=1, 2) sampled during the spark window 610 (i.e., window one), to a failed coil/ion-sensing assembly threshold $TH_{PC}$ to determine whether a coil and ionization sensor assembly failed. This diagnostic subroutine compares the peak ionization signal $P_{11}$ for Bank #1 at window one with a failed coil/ion-sensing threshold $TH_{FC}$ to determine whether an ignition coil and ionization sensor assembly failed in Bank #1 (step 810). The subroutine also compares the peak ionization signal $P_{21}$ for Bank #2 at window one with the failed coil/ion-sensing assembly threshold $TH_{FC}$ to determine whether a coil and ionization sensor assembly failed in Bank #2 (step 820).

If the peak ionization value sampled $P_{11}$ for Bank #1 is less than the failed coil/ion-sensing assembly threshold $TH_{FC}$, the diagnostic subroutine declares a failure in the corresponding coil/ion sensing assembly of Bank #1 (step 815). If the peak ionization signal sampled $P_{11}$ for Bank #1 is not less than the failed coil/ion-sensing assembly threshold $TH_{FC}$, the diagnostic subroutine determines that the corresponding coil and ionization sensor assembly of Bank #1 did not fail during the ignition phase 220. The crank mode diagnostic routine performs a similar subroutine for engine Bank #2. If the peak ionization value sampled $P_{21}$ for Bank #2 is less than the failed coil/ion-sensing assembly of Bank #2 failure occurred during the ignition phase 220 and declares a failure of the corresponding coil/ion-sensing assembly (step 825). If the peak ionization value sampled $P_{21}$ for Bank #2 is not less than the failed coil/ion-sensing assembly threshold $TH_{FC}$, the engine crank mode diagnostic subroutine determines that the corresponding ignition coil and ionization sensor assembly did not fail.

If a failed coil/ion current sensing assembly fault is declared for either cylinder bank, the main processor 330 logs the failure. In addition, the main processor 330 may place the engine into Limp Home Mode, e.g., by limiting engine operating parameters, such as engine rpm, or the main processor 330 may shut down the engine. The main processor 330 may log the failure. The main processor 330 may perform the engine crank mode diagnostic routine several times before declaring a failed coil/ion current sensing fault and initiating Limp Home Mode or engine shut down.

If the engine crank mode diagnostic routine does not detect a failed coil/ion current sensing assembly failure, the crank mode diagnostic routine performs a sensor/input short to battery subroutine for Bank #1 (step 830) and Bank #2 (step 840) using the peak ionization signal sampled $P_{i2}$ (I=1, 2) at the combustion window (window two). The diagnostic subroutine compares the peak ionization signals sampled $P_{12}$ for Bank #1 and sampled $P_{22}$ for Bank #2 with an ion sensor short to battery threshold $TH_{SB}$. If the peak ionization signal sampled $P_{12}$ for Bank #1 is less than the ion sensor short to battery threshold $TH_{SB}$, the diagnostic subroutine declares that at least one of the ionization sensor feedback channels in Bank #1 (step 835) shorts to battery. If the peak ionization value $P_{12}$ for Bank #1 is not less than the sensor short to battery threshold $TH_{SB}$, the diagnostic subroutine determines that there is no ion sensor shorted to battery in Bank #1.

The crank mode diagnostic routine performs a similar subroutine for engine Bank #2 by comparing the peak ionization value $P_{22}$ sampled for Bank #2 to the sensor short to battery threshold $TH_{SB}$ 840. If the peak ionization value sampled $P_{22}$ for Bank #2 is less than the sensor short to battery threshold $TH_{SB}$, the diagnostic subroutine declares that at least one of the ionization sensor feedback channels in Bank #2 (step 845) shorts to battery. If the peak ionization value sampled $P_{22}$ for Bank #2 is not less than the sensor short to battery threshold $TH_{SB}$, the diagnostic subroutine determines that there is no ion sensor input short to battery in Bank #2.

In one embodiment of the invention, the failed coil/ion-sensing threshold $TH_{FC}$ and the sensor short to battery threshold $TH_{SB}$ may be predetermined constants. In another embodiment of the invention, the failed coil/ion-sensing threshold $TH_{FC}$ and the sensor short to battery threshold $TH_{SB}$ may be determined as functions of engine speed, engine load, and similar operational parameters.

If the crank mode diagnostic routine does not detect a failed coil/ion sensing assembly failure or a sensor short to battery failure, the diagnostic routine performs a cylinder identification subroutine to identify the cylinder that is in compression in Bank #1 and/or Bank #2. The dwell duration of each coil is selected so that the cylinder in compression does not spark, because of the relatively high gas mixture density, and the cylinder that is not in compression does spark. This diagnostic subroutine compares the integration ionization signal sampled $INT_{11}$ for Bank #1 and sampled $INT_{21}$ for Bank #2 to a cylinder identification threshold $TH_{ID}$ to determine which cylinder is in a compression stroke. As represented at step 850 in FIG. 9, the subroutine subtracts the integration ionization signal $INT_{21}$ of Bank #2 from the integration ionization signal $INT_{11}$ of Bank #1. If the difference of the integration ionization signal sampled for Bank #1 at window one $INT_{11}$ minus the integration ionization signal sampled for Bank #2 at window one $INT_{21}$ exceeds the cylinder identification threshold $TH_{ID}$, the diagnostic subroutine determines that the Bank #1 cylinder is in compression, and the subroutine sets a cam synchronization flag for Bank #1 (step 855). Similarly, if the difference of the integration ionization signal sampled for Bank #2 at window one $INT_{21}$ minus the integration ionization signal sampled for Bank #1 at window one $INT_{11}$ exceeds the cylinder identification threshold $TH_{ID}$, the subroutine determines that the Bank #2 cylinder is in compression, and the subroutine sets a cam synchronization flag for Bank #2 (step 865).

If the crank mode diagnostic subroutine cannot identify the cylinder that is in compression initially, either because both cylinders sparked or because neither cylinder sparked, the subroutine adjusts the charge duration in a stepwise process, until the cylinder that is in compression does not spark and the cylinder that is not in compression does spark. In this way cylinder identification can occur during the next cylinder identification event, i.e., during the next ignition phase in Bank #1 and Bank #2.

The charge duration adjustment subroutine of the crank mode diagnostic routine operates in the following manner. If the absolute value of the difference between the integration ionization signal $INT_{21}$ sampled for Bank #2 and the integration ionization signal $INT_{11}$ sampled for Bank #1 is not greater than the cylinder identification threshold $TH_{ID}$, the crank mode diagnostic routine compares the sum of $INT_{11}$ and $INT_{21}$ to an ignition threshold $TH_{IGN}$ to determine whether coil charge duration should be increased or decreased (step 870). Thus, if neither diagnostic criteria is satisfied (i.e., $|INT_{21}-INT_{11}| \leqq TH_{ID}$), the charge duration subroutine changes coil charge duration, e.g., through a stepwise or iterative process, so that cylinder identification occur adaptively.

The adaptive dwell duration adjustment subroutine adds the integration ionization signal $INT_{21}$ sampled for Bank #2 and the integration ionization signal $INT_{11}$ sampled for Bank #1 and compares the sum to an ignition threshold $TH_{IGN}$ (step 870). If the sum of the integration ionization signal $INT_{21}$ sampled for Bank #2 and sampled for Bank #1 $INT_{11}$ is greater than the ignition threshold $TH_{IGN}$, the charge duration subroutine determines, at step 870 that both cylinders in Bank #1 and Bank #2 sparked, even though one of those cylinders was in compression. The diagnostic subroutine decreases the coil charge duration in each cylinder bank in a stepwise process during the next combustion cycle, step 875, so that the cylinder that is in compression does not spark during the next combustion cycle, and the cylinder that is not in compression does spark. If the sum of the integration ionization signal $INT_{21}$ sampled for Bank #2 and sampled $INT_{11}$ for Bank #1 is still greater than the ignition threshold $TH_{IGN}$ in the next combustion cycle, the diagnostic subroutine continues to decrease coil charge duration in a stepwise manner, step 870, until the cylinder in compression does not spark and the cylinder that is not in compression does spark. In this way, the crank mode diagnostic routine enables identification of the cylinder that is in compression and sets the synchronization flag.

If the sum of the integration ionization signal $INT_{11}$ sampled for Bank #1 and sampled $INT_{21}$ for Bank #2 is not greater than the ignition threshold $TH_{IGN}$, the crank mode diagnostic routine determines that neither cylinder sparked, and the diagnostic subroutine increases the charge duration in a stepwise process (step 880), until the cylinder that is in not compression sparks, and the cylinder that is in compression continues not to spark. If the sum of the integration ionization signal $INT_{21}$ sampled for Bank #2 and sampled $INT_{11}$ for Bank #1 is not greater than the ignition threshold $TH_{IGN}$ in the next combustion cycle, the diagnostic subroutine continues to increase coil charge duration in a stepwise manner (step 880) until the cylinder that is not in compression sparks and the cylinder that is in compression continues not to spark. In this manner, the charge duration subroutine enables the crank mode diagnostic routine to identify the cylinder that is in compression in Bank #1 and Bank #2 and set the cam synchronization flag.

Figure 10:
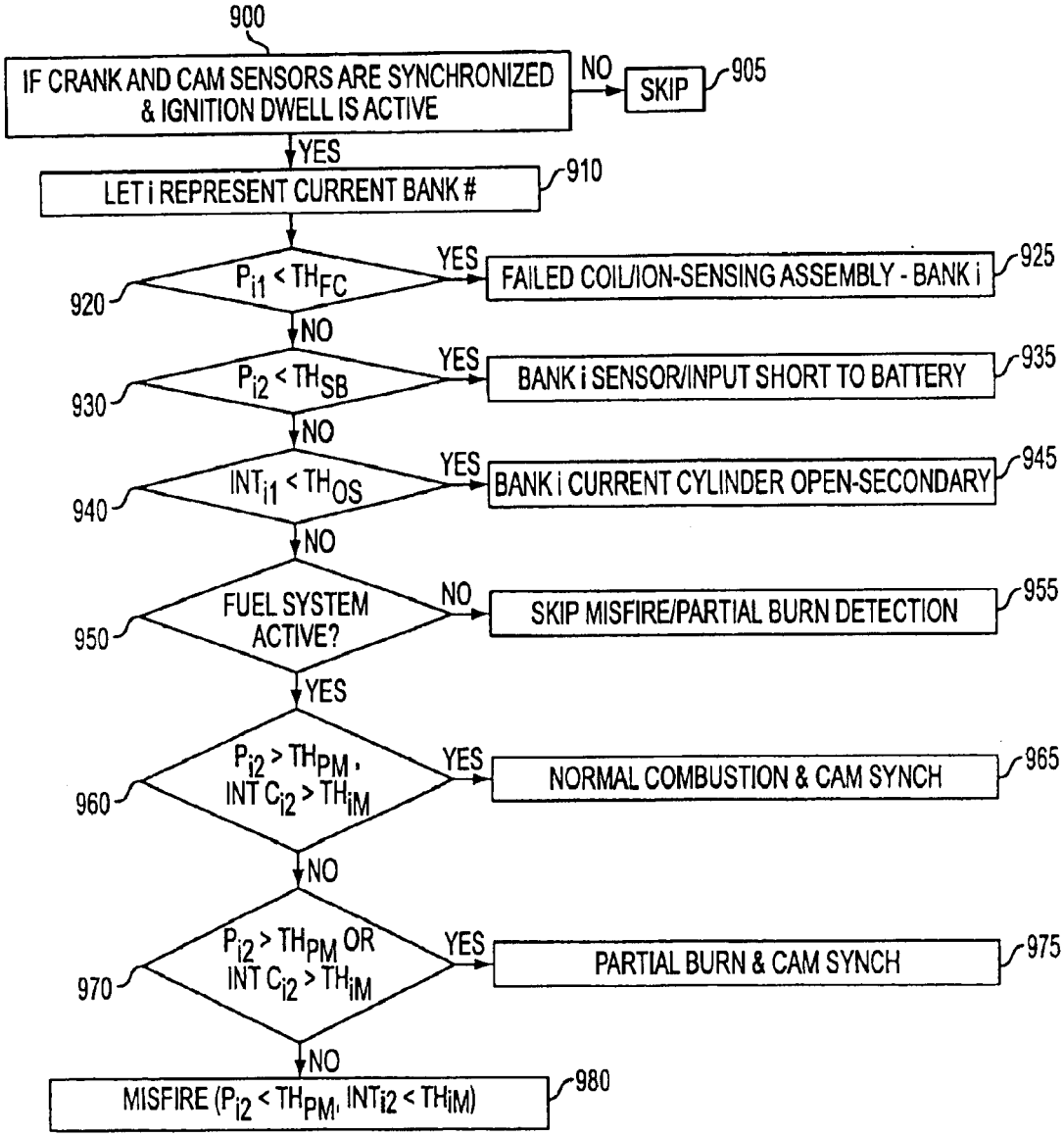
FIG. 10 is a block diagram for a normal operational mode diagnostic routine.

Once the crank mode diagnostic routine identifies the cylinder in compression and sets the cam synchronization flag, the main processor 330 performs a normal operational mode diagnostic routine, as shown in FIG. 10. The preconditions for this diagnostic routine are illustrated at step 900 and include the crankshaft position sensor is synchronized, the camshaft phase, i.e., sensor, is synchronized, and the ignition dwell is active 900, or, in other words, the engine is at its normal operational mode. The crankshaft position sensor is synchronized prior to operation of the crank mode diagnostic routine, as discussed above. The camshaft sensor is synchronized once the crank mode diagnostic routine identifies the cylinder that is in compression. The ignition dwell is set to "Active," so that the coil charge duration is sufficient to ignite the air/fuel mixture during normal engine operation. If the crankshaft position sensor or the camshaft sensor is not synchronized, or if the ignition dwell is not active, the normal operational mode diagnostic routine will not be performed (step 905).

The normal operational mode diagnostic routine performs a failed coil/ion-sensor assembly subroutine and a bank sensor/input short to battery subroutine. The failed coil/ion-sensing diagnostic subroutine compares the peak ionization signal sampled during window one for the current cylinder bank (either Bank #1 or Bank #2) $P_{i1}$ (where "i" represents cylinder Bank #1 or Bank #2) to a failed coil/ion-sensing threshold $TH_{FC}$ (step 920). If the peak ionization signal sampled during window one for the current Bank #1 $P_{i1}$ (i=1 or 2) is less than the failed coil/ion-sensing threshold $TH_{FC}$, the diagnostic subroutine declares the corresponding ignition coil/ion-sensor assembly failure for the current cylinder bank (step 925). If the peak ionization signal sampled for the current bank $P_{i1}$ at window one (i=1 or 2) is not less than the failed coil/ion-sensing threshold $TH_{FC}$, the diagnostic subroutine determines that the corresponding ignition coil/ion-sensor assembly failure did not occur in the current bank.

The normal operational mode diagnostic routine then performs a bank sensor/input short to battery diagnostic subroutine (step 930). This subroutine compares the peak ionization signal sampled during window two for the current bank $P_{i2}$ (where "i" represents cylinder Bank #1 or #2) to a bank sensor short to battery threshold $TH_{SB}$ (step 930). If the peak ionization signal sampled for the current cylinder bank $P_{i2}$ (i=1 or 2) is less than the bank sensor short to battery threshold $TH_{SB}$, the diagnostic subroutine declares a sensor short to battery failure for the current cylinder bank (step 935).

If the peak ionization signals sampled for the current bank $P_{i2}$ (i=1 or 2) are not less than the bank sensor/input short to battery threshold $TH_{SB}$, the normal engine operation diagnostic routine performs an open-secondary diagnostic subroutine (step 940).

The open-secondary diagnostic subroutine compares the integration ionization signal sampled during window one for the current cylinder bank $INT_{i1}$ (i=1 or 2) to an open-secondary threshold $TH_{OS}$ (step 940). If the integration ionization signal sampled for the current cylinder bank $INT_{i1}$ (i=1 or 2) is less than the open-secondary threshold $TH_{OS}$, the diagnostic subroutine declares an open-secondary failure of the corresponding cylinder in the current bank (step 945). If the integration ionization signal sampled for the current cylinder bank at window one $INT_{i1}$ (i=1 or 2) is greater than or equal to the open-secondary threshold $TH_{OS}$, the diagnostic subroutine determines that an open-secondary failure did not occur in the current cylinder bank. In one embodiment of the invention, the open-secondary threshold $TH_{OS}$ can be derived as a function of engine speed, load, and the like. In another embodiment of the invention, the open-secondary threshold $TH_{OS}$ can be a constant value.

Once the normal engine operation diagnostic routine successfully executes the coil/ion-sensing assembly subroutine, the sensor short to battery failure subroutine, and the open-secondary failure subroutine, the normal engine operation diagnostic routine verifies that the engine fuel system is active (step 950). The engine fuel system supplies fuel to the engine cylinder indirectly through the intake port of a port fuel injection (PFT), or directly inside the cylinder for gasoline direct injection (GDI). If the fuel system is active, e.g., the fuel injection system is active, the normal operation diagnostic routine performs an engine misfire/partial burn diagnostic subroutine (step 960).

This subroutine uses the peak and corrected integration values sampled over window two, i.e., during the combustion phase, to perform misfire and partial burn engine diagnostics. This subroutine 960 compares the peak ionization signal sampled for the current cylinder band $P_{i2}$ (i=1 or 2) with a peak misfire threshold $TH_{PM}$. This subroutine 960 also compares the corrected, i.e., normalized, integration ionization signal sampled for the current cylinder bank $INTC_{i2}$ (i=1 or 2) with an integration misfire threshold $TH_{IM}$.

If the peak ionization signal sampled for the current cylinder bank $P_{i2}$ (i=1 or 2) exceeds the peak misfire threshold $TH_{PM}$ and the corrected, i.e., normalized, integration ionization signal sampled for the current cylinder bank $INTC_{i2}$ exceeds the integration misfire threshold $TH_{IM}$, the misfire diagnostic subroutine determines that normal combustion occurred in the corresponding cylinder of the current bank and confirms the cam synchronization flag (step 965).

If only one of the engine misfire/partial burn criteria are satisfied, i.e., if only one of the peak misfire threshold $TH_{PM}$ or the integration misfire threshold $TH_{IM}$ is exceeded (step 970), the diagnostic subroutine declares a partial-burn combustion (step 975). For example, is the peak ionization signal sampled for the current cylinder bank at window two $P_{i2}$ (i=1 or 2) exceeds the peak misfire threshold $TH_{PM}$, but the corrected integration ionization signal sampled for the current cylinder bank at window two $INTC_{i2}$ (i=1 or 2) does not exceed the integration misfire threshold $TH_{IM}$ (step 970), the subroutine declares a partial burn in the corresponding cylinder of the current bank (step 975). Or, if the corrected integration ionization signal sampled for the current bank at window two $INTC_{i2}$ (i=1 or 2) exceeds the integration misfire threshold $TH_{IM}$, but the peak ionization signal sampled for the current cylinder bank at window two $P_{i2}$ (i=1 or 2) does not exceed the peak misfire threshold $TH_{PM}$ (step 970), the subroutine declares a partial burn in Bank #1 975.

If neither criteria $P_{i2}$ and $INTC_{i2}$ (i=1 or 2) exceeds their respective threshold values $TH_{PM}$, $TH_{IM}$, a misfire is declared (step 980). For example, if the peak ionization signal sampled for the current cylinder bank at window two $P_{i2}$ (i=1 or 2) is less than or equal to the peak misfire threshold $TH_{PM}$, and the corrected integration ionization signal sampled for the current cylinder bank at window two $INTC_{i2}$ (i=1 or 2) is less than or equal to the integration misfire threshold $TH_{IM}$, a misfire is declared for the corresponding cylinder in the current cylinder bank (step 980).

The peak misfire threshold $TH_{PM}$ and the integration misfire threshold $TH_{IM}$ may be selected as a function of engine speed and engine load because the peak ionization signal $P_{i2}$ (i=1 or 2) and the integration ionization signal $INTC_{i2}$ (i=1 or 2) may vary as engine speed and engine load conditions change. In another embodiment of the invention, the peak misfire threshold $TH_{PM}$ and the integration misfire threshold $TH_{IM}$ may be constants.

Thus, the present invention reduces the data sample rate needed to perform engine diagnostic routines by a factor of at least 100, compared to known engine diagnostic systems and methods. The engine diagnostic routine can be operated over a broad range of engine rpm and operating conditions. These efficiencies substantially improve the efficiency of engine diagnostics and reduce the cost of the diagnostic system over known systems and methods.

The foregoing discussion discloses and describes an exemplary embodiment of the present invention. One skilled in the art will readily recognize from such discussion, and from the accompanying drawings and claims that various change, modifications and variations can be made therein without departing from the true spirit and fair scope of the invention as defined by the following claims.

What is claimed is:

1. A method of using an ionization signal to perform an engine diagnostic routine comprising:

a) detecting the ionization signal;

b) integrating said ionization signal over a first sampling window to generate a first integration ionization value;

c) detecting a peak of said ionization signal over said first sampling window to generate a first peak ionization value;

d) integrating said ionization signal over a second sampling window to generate a second integration ionization value;

e) detecting a peak of said ionization signal over said second sampling window to generate a second peak ionization value; and f) performing the engine diagnostic routine with at least one of said first integration ionization value, said first peak ionization value, said second integration ionization value, and said second peak ionization value.

2. The method of claim 1 wherein said step of performing said engine diagnostic routine comprises:

performing the engine diagnostic routine during engine crank mode; or performing the engine diagnostic routine during normal engine operational mode, wherein said step a) through step e) are performed for at least two banks of cylinders.

3. The method of claim 1 wherein said step of performing the engine diagnostic routine comprises:

comparing said first peak ionization value to a failed coil/ion-sensing threshold;

declaring an ignition coil/ion-sensing assembly fault if said first peak ionization value is less than said failed coil/ion-sensing threshold;

comparing said second peak ionization value to a sensor/input short to battery threshold;

declaring a sensor short to battery fault if said second peak ionization value is less than said sensor short to battery threshold; and performing a cylinder identification routine by:

subtracting said first integration ionization value for a cylinder in a second bank of cylinders from said first integration ionization value for a cylinder in a first bank of cylinders to create a first difference;

comparing said first difference to said cylinder identification threshold and setting a cam synchronization flag for said cylinder in said first bank in compression when said first difference exceeds said cylinder identification threshold;

subtracting said first integration ionization value for said cylinder in said first bank of cylinders from said first integration ionization value for said cylinder in said second bank of cylinders to create a second difference; and comparing said second difference to said cylinder identification threshold and setting a cam synchronization flag for said cylinder of said second bank in compression when said second difference exceeds said cylinder identification threshold.

4. The method of claim 3 further comprising:

adjusting a coil charge duration in a stepwise manner if said first difference and said second difference do not exceed said cylinder identification threshold; and wherein said stepwise adjustment of said coil charge duration comprises the steps of:

adding said first integration ionization value for said cylinder in said second bank of cylinders to said first integration ionization value for said cylinder in said first bank of cylinders to create a sum;

comparing said sum to an ignition threshold value;

increasing said coil charge duration when said sum exceeds said ignition threshold value; and decreasing said coil charge duration when said sum does not exceed said ignition threshold value.

5. The method of claim 1 further comprising:

determining whether a crank sensor is synchronized;

determining whether a cam synchronization flag is set;

determining whether a soil in a cylinder bank is charged; and performing a crank mode diagnostic routine when said crank sensor is synchronized, said cam synchronization flag is not set, and said coil in said cylinder bank is charged.

6. The method of claim 1 further comprising:

determining whether a crank sensor is synchronized;

determining whether a cam synchronization flag is set;

determining whether an ignition dwell is active; and performing a normal operational mode diagnostic routine when said crank sensor is synchronized, said cam synchronization flag is set, and said ignition dwell is active.

7. The method of claim 1 wherein said step of performing said engine diagnostic routine comprises:

comparing said first peak ionization value to a failed coil/ion-sensing threshold;

declaring an ignition coil/ion-sensing assembly fault when said first peak ionization value is less than said failed coil/ion-sensing threshold;

comparing said second peak ionization value to a sensor short to battery threshold;

declaring a sensor short to battery fault when said second peak ionization value is less than said sensor short to battery threshold;

comparing said first integration ionization value with an open secondary threshold;

declaring an open secondary fault when said first integration ionization value is less than said open secondary threshold; and determining when said fuel system is active.

8. The method of claim 7 further comprising:

performing a misfire and partial burn diagnostic routine, said misfire and partial burn diagnostic routine comprising:

comparing said second peak ionization value to a partial misfire threshold;

comparing a corrected value of said second integration value to a misfire threshold;

declaring a normal combustion when said second peak ionization value and said corrected value of said second integration value exceeds said partial misfire threshold;

declaring a partial-burn when only one of said second peak ionization value and said corrected value of said second integration value exceeds said partial misfire threshold; and declaring a misfire when neither of said second peak ionization value and said corrected value of said second integration value exceeds said partial misfire threshold.

9. A computer system for performing an engine diagnostic routine comprising:

a memory containing a program which performs the steps of:

a) detecting an ionization signal;

b) integrating said ionization signal over a first sampling window to generate a first integration ionization value;

c) detecting a peak of said ionization signal over said first sampling window to generate a first peak ionization value;

d) integrating said ionization signal over a second sampling window to generate a second integration ionization value;

e) detecting a peak of said ionization signal over a second sampling window to generate a second peak ionization value; and f) performing said engine diagnostic routine with at least one of said first integration ionization value, said first peak ionization value, said second integration ionization value, and said second peak ionization value; and a processor for running said program.

10. The computer system of claim 9 wherein said program further performs the steps of:

comparing said first peak ionization value to a failed coil/ion-sensing threshold;

declaring an ignition coil/ion-sensing assembly fault when said first peak ionization value is less than said failed coil/ion-sensing threshold;

comparing said second peak ionization value to a sensor short to battery threshold;

declaring a sensor short to battery fault when said second peak ionization value is less than said sensor/input short to battery threshold; and performing a cylinder identification routine by subtracting said first integration ionization value for a cylinder in a second bank of cylinders from said first integration ionization value for a cylinder in a first bank of cylinders to create a first difference;

comparing said first difference to said cylinder identification threshold and setting a cam synchronization flag for said first bank of cylinders when said first difference exceeds said cylinder identification threshold;

subtracting said first integration ionization value for said cylinder in said first bank of cylinders from said first integration ionization value for said cylinder in said second bank of cylinders to create a second difference; and comparing said second difference to said cylinder identification threshold and setting a cam synchronization flag for said second bank of cylinders if said second difference exceeds said cylinder identification threshold.

11. The computer system of claim 10 wherein said program adjusts a coil charge duration in a stepwise manner when said first difference and said second difference do not exceed said cylinder identification threshold, by:

adding said first integration ionization value for said cylinder in said second bank of cylinders to said first integration ionization value for said cylinder in said first bank of cylinders to create a sum;

comparing said sum to an ignition threshold value;

increasing said coil charge duration if said sum exceeds said ignition threshold value; and decreasing said coil charge duration if said sum does not exceed said ignition threshold value.

12. The computer system of claim 9 wherein said program performs a normal engine operation diagnostic routine, said normal engine operation diagnostic routine comprising:

comparing said first peak ionization value to a failed coil/ion-sensing threshold;

declaring an ignition coil/ion-sensing assembly fault when said first peak ionization value is less than said failed coil/ion-sensing threshold;

comparing said second peak ionization value to a sensor short to battery threshold;

declaring a sensor short to battery fault when said second peak ionization value is less than said sensor/input short to battery threshold;

comparing said first integration ionization value with an open secondary threshold;

declaring an open secondary fault when said first integration ionization value is less than said open secondary threshold; and determining when said fuel system is active.

13. The computer system of claim 12 wherein said program performs a misfire and partial burn diagnostic routine, said misfire and partial burn diagnostic routine comprising:

comparing said second peak ionization value to a partial misfire threshold;

comparing a corrected value of said second integration value to a misfire threshold;

declaring a normal combustion when said second peak ionization value and said corrected value of said second integration value exceeds said partial misfire threshold;

declaring a partial-burn when only one of said second peak ionization value and said corrected value of said second integration value exceeds said partial misfire threshold; and declaring a misfire when neither of said second peak ionization value and said corrected value of said second integration value exceeds said partial misfire threshold.

14. The computer system of claim 9 wherein said program performs the following steps before performing a crank mode engine diagnostic routine:

determining whether a crank sensor is synchronized;

determining whether a cam synchronization flag is set;

determining whether a coil in at least one cylinder bank is charged; and wherein said program performs said crank mode diagnostic routine when said crank sensor is synchronized, said cam synchronization flag is not set, and said coil in said at least one cylinder bank is charged; and further wherein said program performs the following steps before performing a normal engine operation diagnostic routine;

determining whether a crank sensor is synchronized;

determining whether a cam synchronization flag is set;

determining whether an ignition dwell is active; and performing a normal operational mode diagnostic routine when said crank sensor is synchronized, said cam synchronization flag is set, and said ignition dwell is active.

15. A computer-readable medium whose contents cause a computer system to perform an engine diagnostic routine, the computer system having a program which executes the steps of:

a) detecting an ionization signal;

b) integrating said ionization signal over a first sampling window to generate a first integration ionization value;

c) detecting a peak of said ionization signal over said first sampling window to generate a first peak ionization value;

d) integrating said ionization signal over a second sampling window to generate a second integration ionization value;

e) detecting a peak of said ionization signal over a second sampling window to generate a second peak ionization value; and f) performing said engine diagnostic routine with at least one of said first integration ionization value, said first peak ionization value, said second integration ionization value, and said second peak ionization value.

16. The computer readable medium of claim 15 wherein said program further executes the steps of:

comparing said first peak ionization value to a failed coil/ion-sensing threshold;

declaring an ignition coil/ion-sensing assembly fault when said first peak ionization value is less than said failed coil/ion-sensing threshold;

comparing said second peak ionization value to a sensor short to battery threshold;

declaring a sensor short to battery fault when said second peak ionization value is less than said sensor short to battery threshold; and performing a cylinder identification routine by:

subtracting said first integration ionization value for a cylinder in a second bank of cylinders from said first integration ionization value for a cylinder in a first bank of cylinders to create a first difference;

comparing said first difference to said cylinder identification threshold and setting a cam synchronization flag for said cylinder in said first bank of cylinders if said first difference exceeds said cylinder identification threshold;

subtracting said first integration ionization value for said cylinder in said first bank of cylinders from said first integration ionization value for said cylinder in said second bank of cylinders to create a second difference; and comparing said second difference to said cylinder identification threshold and setting a cam synchronization flag for said second bank of cylinders when said second difference exceeds said cylinder identification threshold.

17. The computer readable medium of claim 16 wherein said program further executes the steps of:

adjusting a coil charge duration in a stepwise manner when said first difference and said second difference do not exceed said cylinder identification threshold, wherein said stepwise adjustment of said coil charge duration comprises the steps of:

adding said first integration ionization value for said cylinder in said second bank of cylinders to said first integration ionization value for said cylinder in said first bank of cylinders to create a sum;

comparing said sum to an ignition threshold value;

increasing said coil charge duration when said sum exceeds said ignition threshold value; and decreasing said coil charge duration when said sum does not exceed said ignition threshold value.

18. The computer readable medium of claim 15 wherein said program further executes the steps of:

comparing said first peak ionization value to a failed coil/ion-sensing threshold;

declaring an ignition coil/ion-sensing assembly fault when said first peak ionization value is less than said failed coil/ion-sensing threshold;

comparing said second peak ionization value to a sensor short to battery threshold;

declaring a sensor short to battery fault when said second peak ionization value is less than said sensor/input short to battery threshold;

comparing said first integration ionization value with an open secondary threshold;

declaring an open secondary fault when said first integration ionization value is less than said open secondary threshold; and determining when said fuel system is active.

19. The computer readable medium of claim 18 wherein said program further executes the steps of:

comparing said second peak ionization value to a partial misfire threshold;

comparing a corrected value of said second integration value to a misfire threshold;

declaring a normal combustion when said second peak ionization value and said corrected value of said second integration value exceeds said partial misfire threshold;

declaring a partial-burn when only one of said second peak ionization value and said corrected value of said second integration value exceeds said partial misfire threshold; and declaring a misfire when neither of said second peak ionization value and said corrected value of said second integration value exceeds said partial misfire threshold.

20. The computer readable medium of claim 15 wherein said program further executes the steps of:

determining whether a crank sensor is synchronized;

determining whether a cam synchronization flag is set;

determining whether a coil in at least one cylinder bank is charged; and performing said crank mode diagnostic routine when said crank sensor is synchronized, said cam synchronization flag is not set, and said coil in said at least one cylinder bank is charged;

determining whether a crank sensor is synchronized;

determining whether a cam synchronization flag is set;

determining whether an ignition dwell is active; and performing a normal operational mode diagnostic routine when said crank sensor is synchronized, said cam synchronization flag is set, and said ignition dwell is active.

* * * * *

UNITED STATES PATENT AND TRADEMARK OFFICE

CERTIFICATE OF CORRECTION

PATENT NO. : 6,922,628 B2 
DATED : July 26, 2005
INVENTOR(S) : Guoming G. Zhu et al.

It is certified that error appears in the above-identified patent and that said Letters Patent is hereby corrected as shown below:

Column 1,
Line 54, "diagnostic" should be -- diagnostics --.

Column 2,
Line 4, after "invention" insert -- , --.

Column 3,
Line 8, "access" should be -- assess --.
Line 53, "circumstance" should be -- circumstances --.

Column 7,
Line 63, "$INTC_{12}$" should be -- $INTC_{i2}$ --.

Column 8,
Line 8, "$INTC_{12}$" should be -- $INTC_{i2}$ --.
Line 12, "$INT_{12}=\int Ion(t)dt\times PWM_{DC}=\int Ion(\theta)d\theta\times PWM_{DC}/(6\times RPM)$" should be -- $INT_{i2}=\int Ion(t)dt\times PWM_{DC}=\int Ion(\theta)d\theta\times PWM_{DC}/(6\times RPM)$ --.
Line 18, "$INTC_{12}=\int Ion(\theta)d\theta=6\times RPM\times INT_{12}/PWM_{DC}$" should be -- $INTC_{i2}=\int Ion(\theta)d\theta=6\times RPM\times INT_{i2}/PWM_{DC}$ --.
Line 20, "$INTC_{12}$" should be -- $INTC_{i2}$ --.

Column 11,
Line 47, "$TH_{PC}$" should be -- $TH_{FC}$ --.

Column 12,
Line 1, after "assembly" insert -- threshold $TH_{FC}$, the diagnostic subroutine determines that the ignition coil/ion-sensing assembly --.

Column 15,
Line 23, "PFT" should be -- PFI --.
Line 32, "band" should be -- bank --.
Line 50, "is" should be -- if --.

Column 16,
Line 28, "change" should be -- changes --.

Column 17,
Line 42, "soil" should be -- coil --.

UNITED STATES PATENT AND TRADEMARK OFFICE

CERTIFICATE OF CORRECTION

PATENT NO. : 6,922,628 B2
DATED : July 26, 2005
INVENTOR(S) : Guoming G. Zhu et al.

It is certified that error appears in the above-identified patent and that said Letters Patent is hereby corrected as shown below:

Column 20,
Line 14, ";" should be -- : --.

Signed and Sealed this

Eleventh Day of October, 2005

JON W. DUDAS
*Director of the United States Patent and Trademark Office*